US007762225B2

(12) United States Patent
Dengler

(10) Patent No.: US 7,762,225 B2
(45) Date of Patent: Jul. 27, 2010

(54) VALVE TRAIN OF AN INTERNAL COMBUSTION ENGINE COMPRISING AT LEAST ONE CAMSHAFT

(75) Inventor: Stefan Dengler, Ingolstadt (DE)

(73) Assignee: Audi AG, Ingolstadt (DE)

( * ) Notice: Subject to any disclaimer, the term of this patent is extended or adjusted under 35 U.S.C. 154(b) by 0 days.

(21) Appl. No.: 10/577,048

(22) PCT Filed: Oct. 16, 2004

(86) PCT No.: PCT/EP2004/011697

§ 371 (c)(1),
(2), (4) Date: Apr. 24, 2006

(87) PCT Pub. No.: WO2005/040562

PCT Pub. Date: May 6, 2005

(65) Prior Publication Data

US 2007/0034182 A1 Feb. 15, 2007

(30) Foreign Application Priority Data

Oct. 25, 2003 (DE) ..... 103 49 898

(51) Int. Cl.
*F01L 1/04* (2006.01)

(52) U.S. Cl. ..... 123/90.6; 123/90.44; 29/888.1

(58) Field of Classification Search ..... 123/90.39, 123/90.44, 90.6, 90.31, 90.27, 90.16, 90.18; 29/888.1

See application file for complete search history.

(56) References Cited

U.S. PATENT DOCUMENTS

| | | | | |
|---|---|---|---|---|
| 1,556,410 | A | 10/1925 | Boyer | |
| 2,888,837 | A * | 6/1959 | Hellmann | 74/568 R |
| 3,963,379 | A * | 6/1976 | Ueno | 417/237 |
| 5,129,407 | A * | 7/1992 | Phillips | 123/90.18 |
| 6,425,359 | B2 * | 7/2002 | Fujii et al. | 123/90.18 |
| 7,036,483 | B2 * | 5/2006 | El Tahry et al. | 123/316 |
| 7,409,938 | B2 * | 8/2008 | Dengler | 123/90.18 |

FOREIGN PATENT DOCUMENTS

DE 100 54 623 5/2002

* cited by examiner

*Primary Examiner*—Ching Chang
(74) *Attorney, Agent, or Firm*—Novak Druce + Quigg LLP

(57) ABSTRACT

The invention relates to valve train of an international combustion engine, which comprise axially displaceable cam elements. The inventive valve train is characterized in that one cam element comprises at least two cams which in turn comprise at least two cam tracks. The first cam and the at least second cam of a cam element differ in at least one cam track.

10 Claims, 1 Drawing Sheet

VALVE TRAIN OF AN INTERNAL COMBUSTION ENGINE COMPRISING AT LEAST ONE CAMSHAFT

Figure 1:
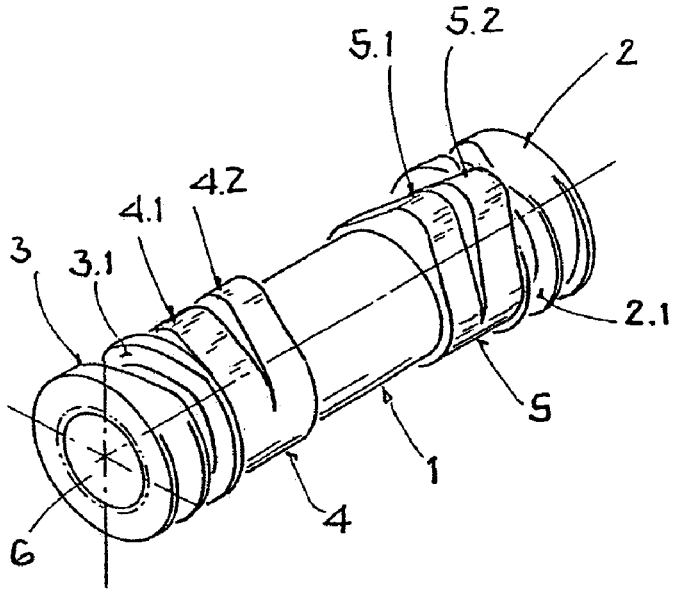

This application is a §371 application of PCT/EP2004/011697, which claims priority from DE 1034989.2, filed Oct. 25, 2003.

The invention relates to the valve train of an internal combustion engine comprising at least one camshaft.

Mechanical devices which affect the operating cycle of the valve train and, for example, make possible a speed-dependent change in the opening times or the lift of the gas exchange valves have been disclosed with the aim of improving the thermodynamic properties of internal combustion engines.

Publication DE 42 30 877 discloses such a device, one in which one cam element is mounted so as to be non-rotatable and axially displaceable on a base camshaft. The cam element consists of a tubular support on which at least one cam is mounted, one from which several different cam tracks extend axially from a common base circle. A gas exchange valve is actuated by the variously shaped cam tracks as a result of axial displacement of the cam element on the base camshaft, the cam tracks being variable with respect to lift configuration and/or phase position.

An advantageous device for axial displacement of a cam element has been disclosed in publication EP 0 798 451, which states that a worm drive is configured on both sides of the cam element, this worm drive having in the form of a recess a curved track which may be engaged by a positioning element for the purpose of axial displacement of the cam element.

Publication DE 101 48 243 describes a cam element on which two cams are mounted for actuation of two gas exchange valves on the intake side of a cylinder, each of the two valves having two curved tracks.

The invention has the object of providing a valve train with cam elements of an internal combustion engine as specified in the preamble of the patent claim, one in which the cam element is further developed so that other functions may be performed by the valve train.

The filling of a combustion chamber can be significantly affected by different cam tracks by means of which, for example, the gas exchange valves on the inlet side of a cylinder may be actuated at different times. For example, initiation of a tumble flow may be caused.

In an advantageous development of the invention provision is made such that the first cam and the at least second cam of a cam element differ from each other in all cam tracks.

Provision is made such that the cam tracks of the first cam and the at least second cam of a cam element differ from each other in lift configuration and/or phase position.

The lift configuration of a cam determines the beginning of opening of the gas exchange valve, the course of opening of the gas exchange valve, the maximum lift of the gas exchange valve, the course of closing of the gas exchange valve, and the closing of the gas exchange valve.

The phase position determines the angle of rotation of the camshaft at which the maximum lift of the lift configuration is positioned. The angle of rotation of the camshaft at which the gas exchange valve opens or closes for a given lift configuration is also thereby determined.

The cam tracks may differ in that the maximum lift of the lift configuration of one cam configuration describes a cam track outside the lift configuration of the other cam track.

The gas exchange processes in the combustion chambers of the cylinder may be influenced in a number of ways by the valve train of an internal combustion engine as claimed for the invention.

The valve train of an internal combustion engine as claimed for the invention will be described in what follows and explained on the basis of an exemplary embodiment, with reference to two figures, in which FIG. 1 illustrates a cam element having two cams each of which has two cam tracks and FIG. 2 the four different cam configurations of the two cams of the cam element.

A six-cylinder internal combustion engine with two upper camshafts for driving a motor vehicle is equipped with a device for regulating the lift and the opening times of the gas exchange valves on the intake side. The device consists of six cam packets mounted so as to be non-rotatable and axially displaceable on the camshaft actuating the gas exchange valves on the intake side. Each cam packet is associated specifically with one cylinder, each cylinder of the internal combustion engine having two gas exchange valves on the intake side. Two cams are accordingly configured on the cam element, each cam actuating a gas exchange valve on the intake side.

A respective worm drive in which a curved track in the form of a recess is formed on both sides of the cam elements for the purpose of axial displacement. The curved tracks of the two worm drives of a cam element are configured to be mirror images of each other, so that the cam element may be displaced axially in both directions.

Axial displacement of the cam elements is effected by positioning elements mounted radially in relation to the camshaft. The positioning elements are in the form of electromagnetic valves and each consists of an actuating pin and two electromagnets. The positioning elements are rigidly connected to the cylinder head of the internal combustion engine. The actuating pin may be extended and retracted by the electromagnets. When in the extended position the actuating pin is engaged in the recess forming the curved track of a worm drive, the cam element being displaced axially by rotation of the camshaft during operation of the internal combustion engine.

The connection between the camshaft and the cam element permitting torsional strength accompanied by axial displaceability consists of gearing configured on the camshaft as external gearing and in the cam element as interior gearing. The gearing is in the form of multiple gearing.

Each of the two cams of a cam element has two cam track, one cam track for small lift of the gas exchange valve and one cam track for large lift of the gas exchange valve. The cam track with the small lift is engaged at engine speeds below 2500 revolutions per minute and the cam track with the large lift is engaged at engine speeds below 2500 revolutions per minute.

FIG. 1 presents a diagram of a first cam 4 and a second cam 5, the two cams 4, 5 each having two cam tracks 4.1, 4.2, 5.1, 5.2. A respective worm drive 2, 3 is configured on both faces of the cam element 1. Each of the worm drives 2, 3 has a curved track 2.1, 3.1 in which the positioning elements for displacement of the cam element 1 are engaged.

The two cam tracks 4.1, 5.2 with small lift and the two cam tracks 4.2, 5.2 with large lift are not fully identical in design.

Figure 2:
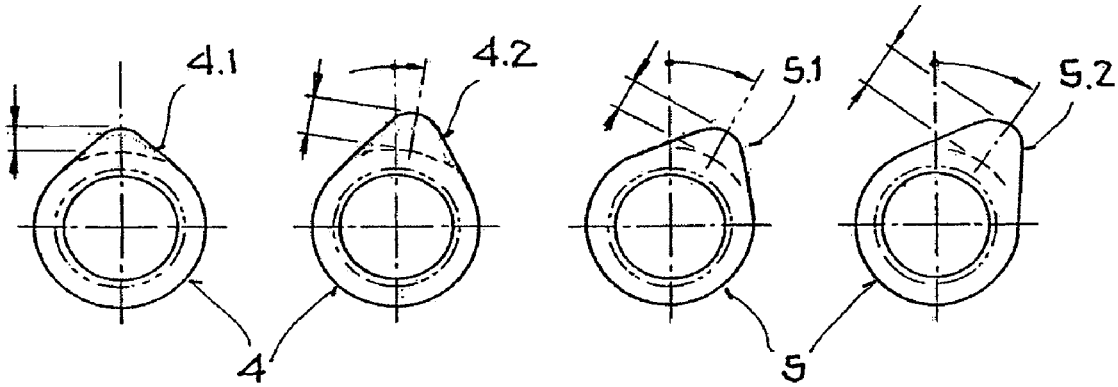

FIG. 2 shows the four different lift configurations of the two cams 4, 5 of the cam element 1, each having two cam tracks 4.1, 4.2, 5.1, 5.2. Of the two cam tracks 4.1, 5.1 having small cam lift, cam track 5.1 has a lift configuration by means of which the gas exchange valve is opened at an earlier camshaft rotation angle. In addition, the maximum cam lift of cam track 5.1 is slightly higher than the cam lift of cam track 4.1. Closing of the gas exchange valve takes place slightly earlier with cam track 5.1 than with cam track 4.1. This configuration of the cam tracks 4.1, 5.1 having the small cam lift greatly promotes development of a tumble flow supporting lean operation.

Of the two cam tracks 4.2, 5.2 exhibiting large cam lift, cam track 5.2 has a lift configuration whereby the gas exchange valve is opened at an earlier camshaft rotation angle. The maximum cam lift of cam track 4.2 is slightly smaller than the cam lift of cam track 5.2. Closing of the gas exchange valve takes place slightly earlier with cam track 4.2 than with cam track 5.2. This configuration has been found in development to be advantageous for filling the cylinders with fresh air at engine speeds above 2500 revolutions per minute.

The maximum lift of the lift configuration of the cams 4, 5 shown in FIGS. 1 and 2 always falls within the lift configuration of the other cam track. Generally speaking, the tracks of a cam may be differentiated in configuration so that the maximum lift of the lift configuration of one cam track is configured outside the lift configuration of the other cam track.

The thermodynamic advantages of the axially displaceable cam elements may be further optimized by the valve train of the internal combustion engine claimed for the invention with cam elements having four different cam tracks.

| Reference Number List | |
|---|---|
| cam element | 1 |
| right worm drive | 2 |
| curved track | 2.1 |
| left worm drive | 3 |
| curved track | 3.1 |
| first cam | 4 |
| left small cam track | 4.1 |
| left large cam track | 4.2 |
| second cam | 5 |
| right small cam track | 5.1 |
| right large cam track | 5.2 |
| multiple gearing | 6 |

The invention claimed is:

1. A camshaft of an internal combustion engine having at least one cylinder and two fuel inlet valves for said cylinder comprising a shaft having a first, rigidly mounted cam element provided with first and second peripheral tracks engageable with one of said fuel inlet valves, each of said first and second tracks including a lobe, a second, rigidly mounted cam element provided with third and fourth peripheral tracks engageable with the other of said fuel inlet valves, each of said third and fourth peripheral tracks including a lobe, and means cooperable with an external component for selectively axially displacing said shaft, wherein each of said tracks differs from each of the other of said tracks.

2. A camshaft according to claim 1 wherein the radius of the lobe of each of said tracks differs from the radius of each of the other of said tracks.

3. A camshaft according to claim 1 wherein the radius of the lobe of said third track is greater than the radius of the lobe of said first track.

4. A camshaft according to claim 1 wherein the radius of the lobe of said fourth lobe is greater than the lobe of said second track.

5. A camshaft according to claim 1 wherein the lobe of said third track is angularly displaced relative to the lobe of said first track, relative to the axis of said shaft.

6. A camshaft according to claim 1 wherein the lobe of said fourth track is angularly displaced relative to the lobe of said second track, relative to the axis of said shaft.

7. A camshaft according to claim 1 wherein the lobe of said third track has a radius greater than the lobe of said first track and is angularly displaced relative to the lobe of said first track, relative to the axis of said shaft.

8. A camshaft according to claim 1 wherein the lobe of said fourth track has a radius greater than the lobe of said second track and is angularly displaced relative to the lobe of said second track, relative to the axis of said shaft.

9. A camshaft according to claim 1 wherein said means cooperable with an external component for axially displacing said shaft comprises at least one helical groove in said shaft receptive to an insertive member adapted to be displaced along a line of travel disposed parallel to the axis of said shaft.

10. A camshaft according to claim 9 including a pair of said helical grooves, each disposed adjacent one of said cam elements.

* * * * *